US010350126B1

(12) United States Patent
Wessel et al.

(10) Patent No.: US 10,350,126 B1
(45) Date of Patent: Jul. 16, 2019

(54) CASKET ORNAMENT ATTACHMENT MECHANISM

(71) Applicant: Batesville Services, Inc., Batesville, IN (US)

(72) Inventors: Christopher M. Wessel, Metamora, IN (US); Gregory Wray, Guilford, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 15/982,403

(22) Filed: May 17, 2018

(51) Int. Cl.
*A61G 17/04* (2006.01)
*A61G 17/007* (2006.01)

(52) U.S. Cl.
CPC ..... *A61G 17/0407* (2017.05); *A61G 17/0076* (2013.01); *A61G 17/04* (2013.01)

(58) Field of Classification Search
CPC ..... A61G 17/04; A61G 17/0076; A61G 17/0407; A61G 17/02; A61G 17/08; G09F 7/04; F16B 21/09
USPC ..... 27/1, 2, 10, 14, 19; 52/288.1; 403/353, 403/DIG. 1; 40/600, 661.06, 711, 124.04; 428/542.4, 900, 913.3
See application file for complete search history.

(56) References Cited

U.S. PATENT DOCUMENTS 2,659,169 A * 11/1953 Brennan ..... A44C 17/0216 206/818
RE25,525 E * 2/1964 Harrell ..... A61G 17/04 248/222.11
6,557,222 B2 * 5/2003 Groennnninger ..... A61G 17/04 27/10
6,591,466 B1 * 7/2003 Acton ..... A61G 17/04 27/10
6,691,385 B2 * 2/2004 Bell ..... A61G 17/04 27/1
6,715,190 B2 4/2004 Groemminger et al.
6,928,706 B2 8/2005 Acton et al.
7,159,287 B2 1/2007 Parker et al.
7,584,529 B1 9/2009 Parker
7,591,052 B2 * 9/2009 Bovard ..... A61G 17/04 27/10
7,657,981 B2 2/2010 Parker
7,698,792 B1 * 4/2010 Parker ..... A61G 17/00 27/10
8,220,119 B2 * 7/2012 Burlage ..... A61G 17/04 27/14

(Continued)

*Primary Examiner* — William L Miller
(74) *Attorney, Agent, or Firm* — Wood Herron & Evans LLP

(57) ABSTRACT

A casket comprises a casket shell, a casket lid closeable on the shell, at least one keyhole groove in the shell, a medallion casket ornament having a rear side, the ornament including at least one magnet mounted on the rear side, and an adapter plate having at least one rearward facing fastener with a head thereon and having a forward facing annular magnetic plate. The adapter plate is removably secured to the shell by inserting the head of the fastener in the keyhole groove and seating the head of the fastener in the keyhole groove. The ornament is removably secured to the shell by positioning the at least one magnet of the ornament on the annular magnetic plate. The ornament is plumbed by rotating the ornament relative to the adapter plate until the ornament is plumb.

20 Claims, 10 Drawing Sheets

(56) References Cited

U.S. PATENT DOCUMENTS

| | | | | |
|---|---|---|---|---|
| 8,387,219 | B2 * | 3/2013 | Rojdev | A61G 17/04 27/10 |
| 8,555,471 | B2 * | 10/2013 | Rojdev | A61G 17/04 27/14 |
| 8,756,774 | B2 * | 6/2014 | Rojdev | A61G 17/04 27/14 |
| 9,132,054 | B2 * | 9/2015 | Rojdev | A61G 17/04 |
| 2010/0293826 | A1 * | 11/2010 | Mottola | B60R 13/005 40/590 |
| 2010/0299895 | A1 * | 12/2010 | Burlage | A61G 17/04 27/14 |
| 2012/0266423 | A1 * | 10/2012 | Rojdev | A61G 17/04 27/1 |
| 2013/0074299 | A1 * | 3/2013 | Rojdev | A61G 17/04 27/14 |
| 2014/0026377 | A1 * | 1/2014 | Rojdev | A61G 17/007 27/3 |
| 2015/0026938 | A1 * | 1/2015 | Rojdev | A61G 17/04 27/14 |

* cited by examiner

CASKET ORNAMENT ATTACHMENT MECHANISM

RELATED APPLICATIONS

N/A

FIELD OF THE INVENTION

This invention relates generally to caskets, and more particularly to mechanisms for attaching ornaments to caskets, urns, and other funerary articles.

BACKGROUND OF THE INVENTION

It is known to attach decorative ornaments to caskets to "personalize" the casket to the deceased. Examples of mechanisms for attaching ornaments to the exterior of a casket, for example to the corners of the casket shell, are shown in, for example, the assignee's U.S. Pat. Nos. 6,591,466, 6,928,706, 7,591,052, and 7,698,792, all hereby incorporated by reference herein as if fully set forth in their entireties. Examples of mechanisms for attaching ornaments to the interior of a casket, for example to the cap panel mounted in the underneath side of the head end casket cap, are shown in, for example, the assignee's U.S. Pat. No. 8,220,119, hereby incorporated by reference herein as if fully set forth in its entirety.

One embodiment of the ornaments for attachment to the cap panel disclosed in the '119 patent utilizes one or more magnets mounted on the rear side of the "medallion" style ornament for magnetically attaching the medallion to a magnetic cap panel. On the other hand, the casket corner ornaments of the '466, '706, and '792 patents utilize fasteners with heads, mounted on the rear side of the ornament, which are secured in L-shaped keyhole slots in the casket shell corners.

It was desirable to be able to utilize the medallion ornaments with magnets thereon with the casket shell L-shaped keyhole slots so that the medallions can also be mounted on the casket shell corners.

To that end, one solution is shown in the assignee's U.S. Pat. No. 8,387,219, hereby incorporated by reference herein as if fully set forth in its entirety. The '219 patent discloses a casket comprising a casket shell and a casket lid closeable on the shell. A mounting plate is mounted to the shell. The plate includes at least one keyhole groove therein. A medallion casket ornament has at least one magnet mounted on its rear side. A magnetic adapter plate has at least one fastener with a head thereon mounted on its rear side. The adapter plate is removably secured to the shell by inserting the head of the fastener in the keyhole groove in the mounting plate and seating the head of the fastener in the keyhole groove. The casket ornament is removably secured to the shell by positioning the at least one magnet of the ornament on the adapter plate. See Prior Art FIG. 1.

An improvement to the attachment mechanism shown in Prior Art FIG. 1 is shown in Prior Art FIG. 2. Whereas in Prior Art FIG. 1 the entire adapter plate is fabricated of ferrous material, in the improved attachment mechanism shown in Prior Art FIG. 2 the adapter plate is injection molded of plastic. Two rearward facing fasteners, each with a head thereon, are molded into the plastic adapter plate. Three forward facing ferrous washers are also molded into the plastic adapter plate. Each washer is positioned in one of three recesses, also molded into the plastic adapter plate.

The assignee's U.S. Pat. Nos. 8,555,471 and 8,756,774, hereby incorporated by reference herein as if fully set forth in their entirety, disclose custom medallions that can be fabricated on site by a funeral director with family member-supplied or funeral director-supplied photos, artwork, or other images. However, due to the fact that these custom medallions are hand assembled, the photo, artwork, or other image may not be "plumb" relative to the three magnets of the medallion, thus resulting in a canted photo, image, or other artwork once the custom medallion is attached to the adapter plate shown in Prior Art FIG. 2, which is mounted to the casket shell.

Accordingly, further improvement is desired.

SUMMARY OF THE INVENTION

In one aspect a casket comprises a casket shell, a casket lid closeable on the shell, at least one keyhole groove in the shell, a medallion casket ornament having a rear side, the ornament including at least one magnet mounted on the rear side, and an adapter plate having at least one rearward facing fastener with a head thereon and having a forward facing annular magnetic plate. The adapter plate is removably secured to the shell by inserting the head of the fastener in the keyhole groove and seating the head of the fastener in the keyhole groove. The ornament is removably secured to the shell by positioning the at least one magnet of the ornament on the annular magnetic plate. The ornament is plumbed by rotating the ornament relative to the adapter plate until the ornament is plumb.

The shell can include two vertically spaced keyhole grooves therein, each being L-shaped, and the adapter plate can include two vertically spaced fasteners. The ornament can include three magnets mounted on the rear side, the three magnets being equally spaced around a circumference of the ornament. The adapter plate can be injection molded of plastic. The fasteners can be metallic, and the fasteners and the annular magnetic plate can be molded into the adapter plate. The adapter plate can be circular, include a forwardly projecting flange around a circumference thereof, and include a forwardly projecting circular feature located centrally thereof, and the annular magnetic plate can be recessed relative to the flange and the circular feature thereby forming an annular track, whereby rotating the ornament relative to the adapter plate causes the three magnets to slide on the annular magnetic plate while being retained in the track. The adapter plate and ornament can be generally circular, with the diameter of the adapter plate being less than the diameter of the ornament. The adapter plate and ornament can be generally disk-shaped. The adapter plate can include an edge scallop that facilitates grasping the periphery of the adapter plate to separate the adapter plate from the ornament.

In another aspect, a funerary receptacle for containing remains of a deceased comprises a container adapted to contain the remains, a lid closeable on the container, at least one keyhole groove in the container, a medallion funerary receptacle ornament having a rear side, the ornament including at least one magnet mounted on the rear side, and an adapter plate having at least one rearward facing fastener with a head thereon and having a forward facing annular magnetic plate. The adapter plate is removably secured to the container by inserting the head of the fastener in the keyhole groove and seating the head of the fastener in the keyhole groove. The ornament is removably secured to the container by positioning the at least one magnet of the ornament on the magnetic annular plate. The ornament is plumbed by rotating the ornament relative to the adapter plate until the ornament is plumb.

The container can be either a casket shell or a cremation urn.

In another aspect, a funerary article comprises a mounting surface including at least one keyhole groove therein, a medallion funerary article ornament having a rear side, the ornament including three circumferentially equally spaced magnets mounted on the rear side, and a plastic adapter plate having at least one rearward facing metallic fastener with a head thereon and having a forward facing annular magnetic plate. The adapter plate is removably secured to the mounting surface by inserting the head of the fastener in the keyhole groove in the mounting surface and seating the head of the fastener in the keyhole groove. The ornament is removably secured to the adapter plate by positioning the magnets of the ornament on the annular magnetic plate. The ornament is plumbed by rotating the ornament relative to the adapter plate until the ornament is plumb.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 3:
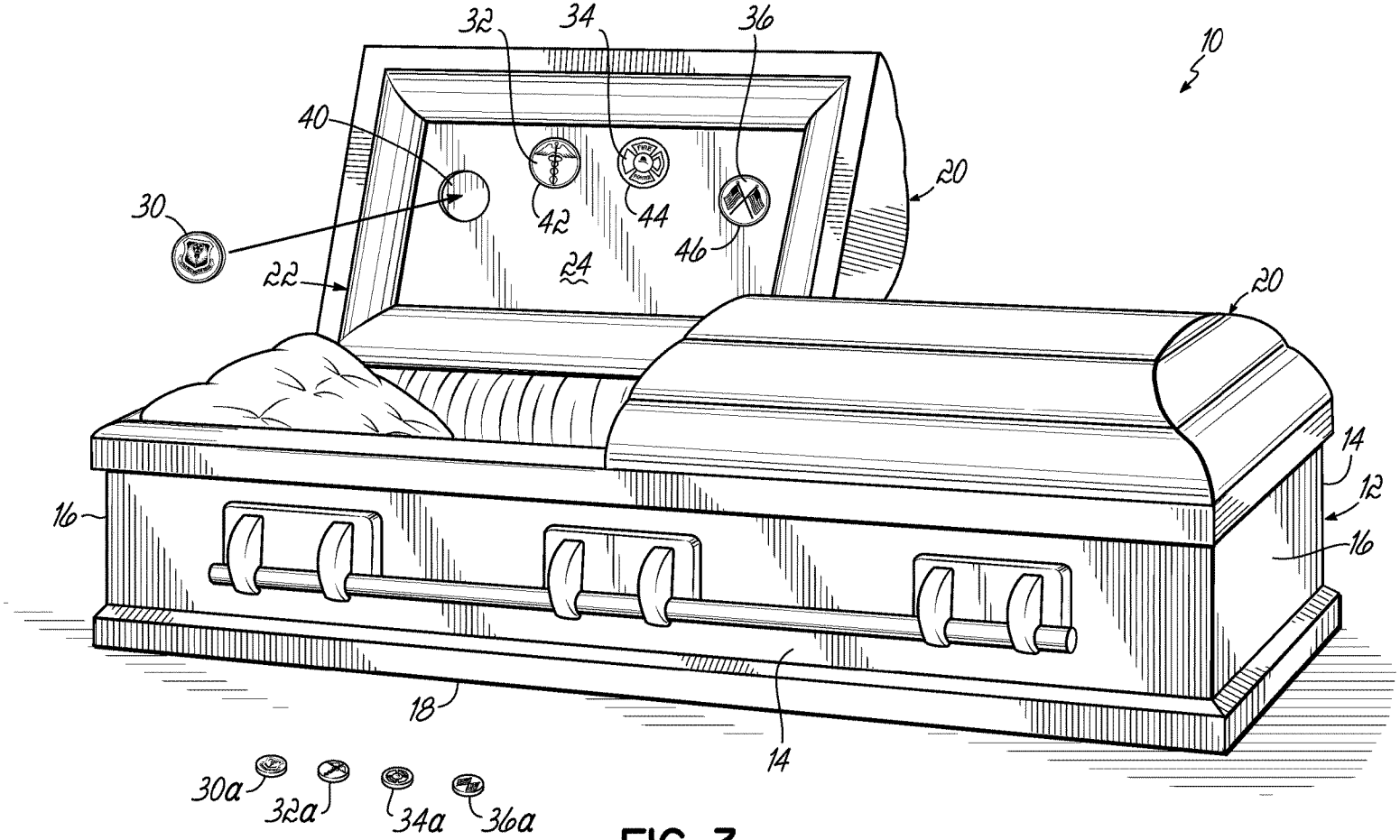
FIG. 3 is a perspective view of a casket with recesses formed in the cap panel each of which is adapted to receive a medallion ornament therein for display.

Referring first to FIG. 3, a casket 10 has a shell 12 adapted to receive the remains of a deceased having a pair of side walls 14, 14, a pair of end walls 16, 16, and a bottom wall 18, and a cap 20 closable on the shell 12. The casket may have a pair of caps or a single cap the full length of the casket. Cap 20 has an ornamental dish assembly 22 mounted to an underside of the cap 20. The dish assembly 22 includes a cap panel 24. At least one medallion 30 is mounted on either an interior surface or an exterior surface of either the shell 12 or cap 20. The medallion 30 has text/or graphics representing a life aspect of the deceased, for example, Father, Brother, Husband, Lawyer, Christian, Hunter, Fisherman, etc. and may be fabricated of a metallic or non-metallic material.

The medallion 30 can be mounted in a recess 40 in the cap panel 24, for example. As another example, the medallion 30 can be mounted in a recess in an exterior surface of the cap 20. The recess 40 can have a circumferential shape that matches a circumferential shape of the medallion 30. The circumferential shapes of the recess 40 and the medallion 30 can be circular, for example, as illustrated.

Four medallions 30, 32, 34, 36 can be mounted in respective recesses 40, 42, 44, 46. The recesses 40, 42, 44, 46 can be formed in the cap panel 24 such that the medallions 30, 32, 34, 36 mounted therein are arranged in an arcuate pattern, as shown in FIG. 3. The medallion(s) can be mounted in the recess with a fastener such as double sided tape, hook and loop fastener, adhesive, magnets, or simply by a press-fit. Outfitting the casket 10 with plural themed medallions 30, 32, 34, 36 permits plural life roles of the deceased to be displayed and celebrated instead of only a single life role per current casket personalization.

Reduced scale medallions 30*a*, 32*a*, 34*a*, 36*a* can be supplied or provided with the casket 10. The reduced scale medallions 30*a*, 32*a*, 34*a*, 36*a* correspond to the full size medallions 30, 32, 34, 36 in that they have substantially the same shape, text, and graphics of the full size medallions 30*a*, 32*a*, 34*a*, 36*a*. However, the reduced scale medallions 30*a*, 32*a*, 34*a*, 36*a* are sized to fit in a pocket of an article of clothing worn by a surviving loved one of the deceased. For example, the reduced size medallions can be about the size and shape of a coin permitting easy carry in a pocket, purse, etc.

In use, the funeral director displays the deceased in a casket 10 having at least one medallion 30 mounted as described above. Subsequent to the viewing, the funeral director presents the substantially identical reduced size medallion 30*a* to the survivor of the deceased for carry in a pocket or purse as a keepsake and reminder of the life of the deceased. Prior to the funeral director presenting the medallion 30*a* to the survivor, it can be engraved on its rear side with the name and birth and death dates of the deceased.

Figure 4:
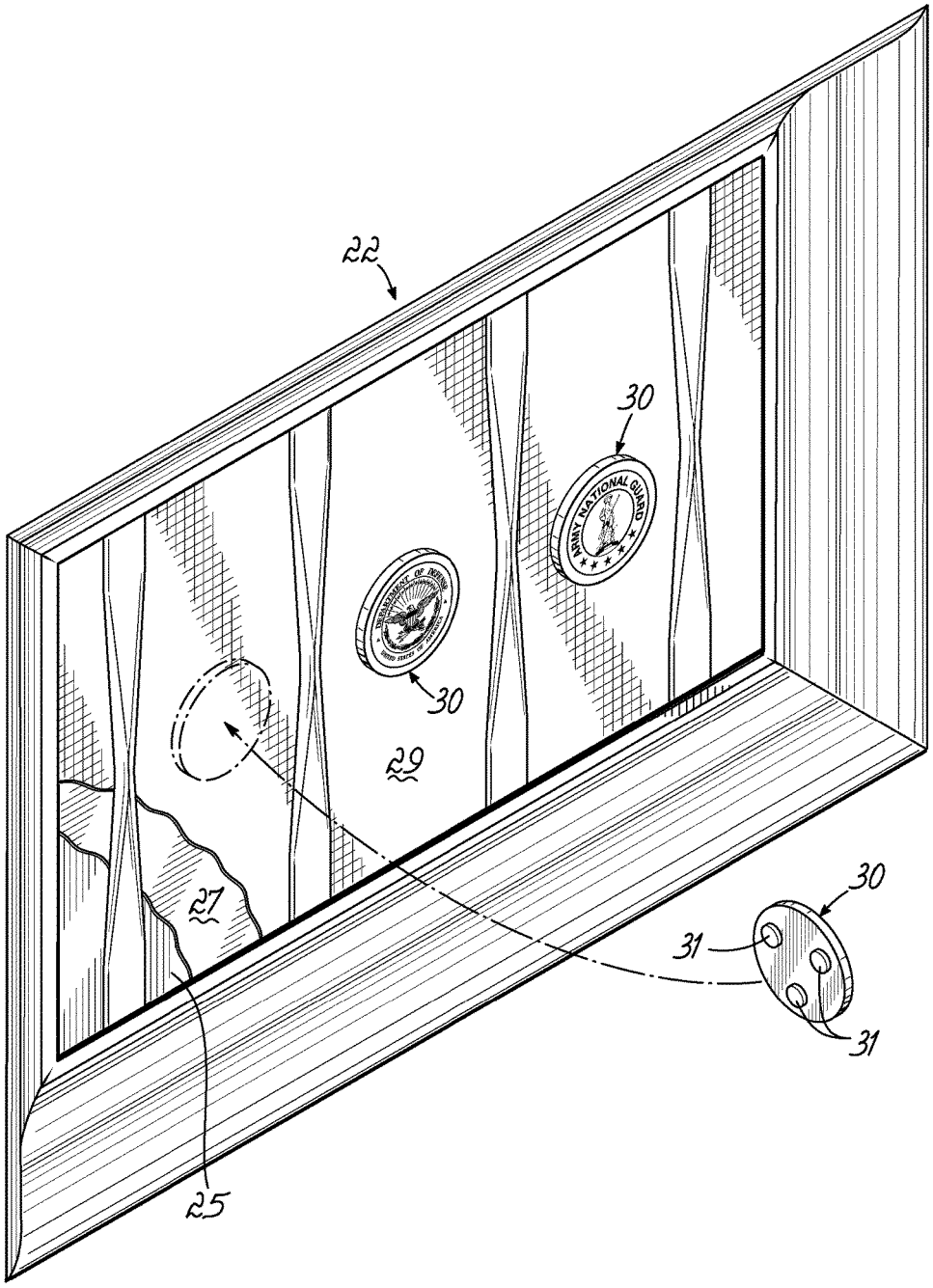
FIG. 4 is a perspective view of a magnetic casket cap panel adapted to have medallion ornaments having magnets on the backs thereof placed thereon for display.
Figure 5A:
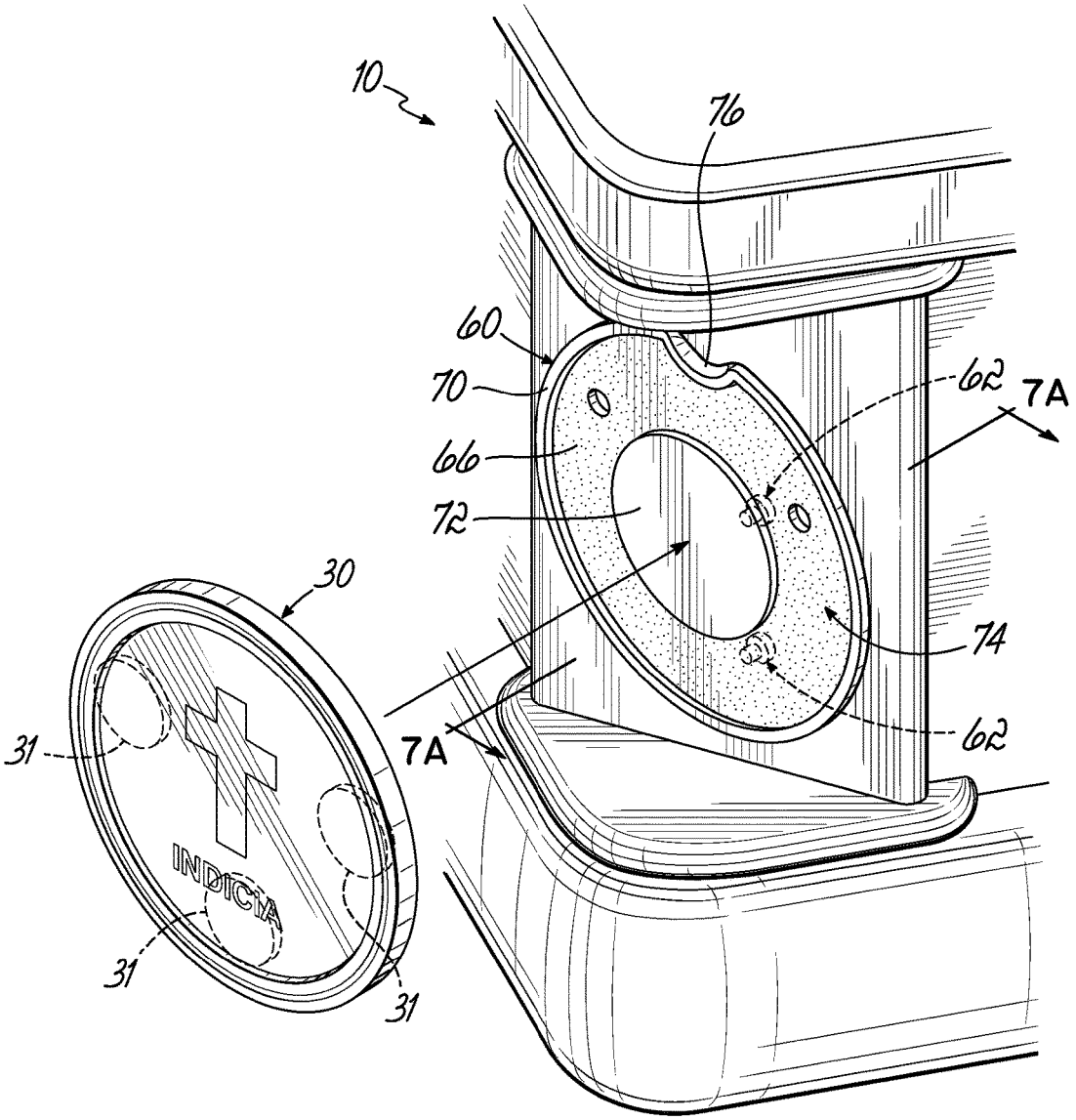
FIG. 5A is a disassembled perspective view of an adapter plate embodying the principles of the present invention for attaching a medallion ornament to a casket corner.
Figure 5B:
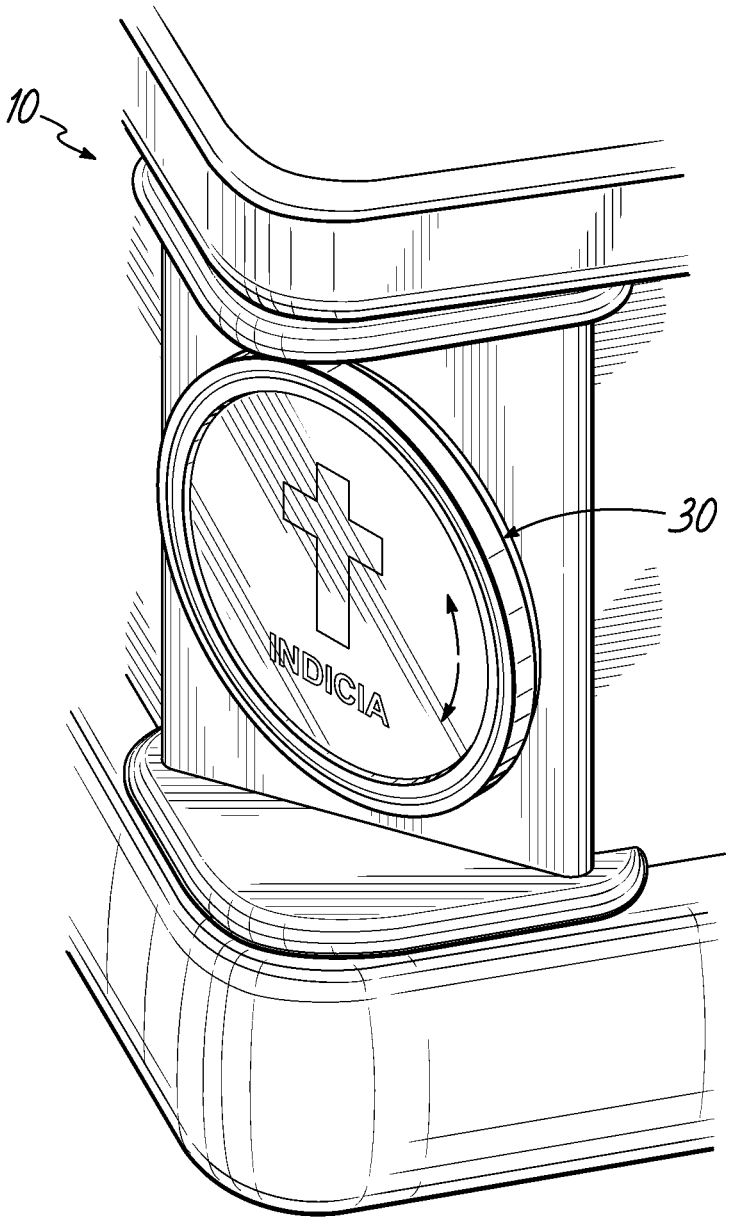
FIG. 5B is an assembled perspective view of the adapter plate and medallion ornament of FIG. 5A.
Figure 6A:
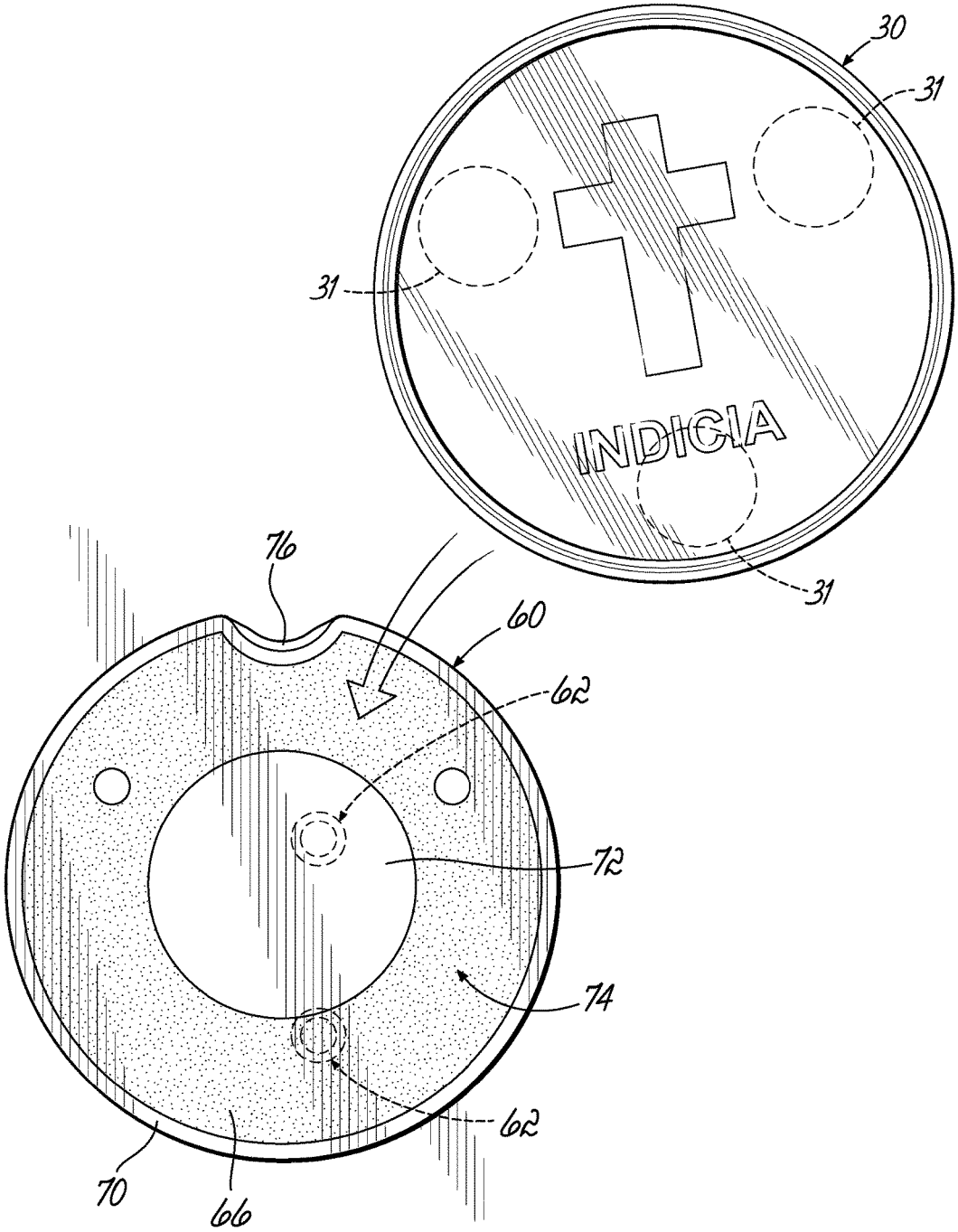
FIG. 6A is a disassembled front view of the adapter plate and medallion of FIG. 5A.
Figure 6B:
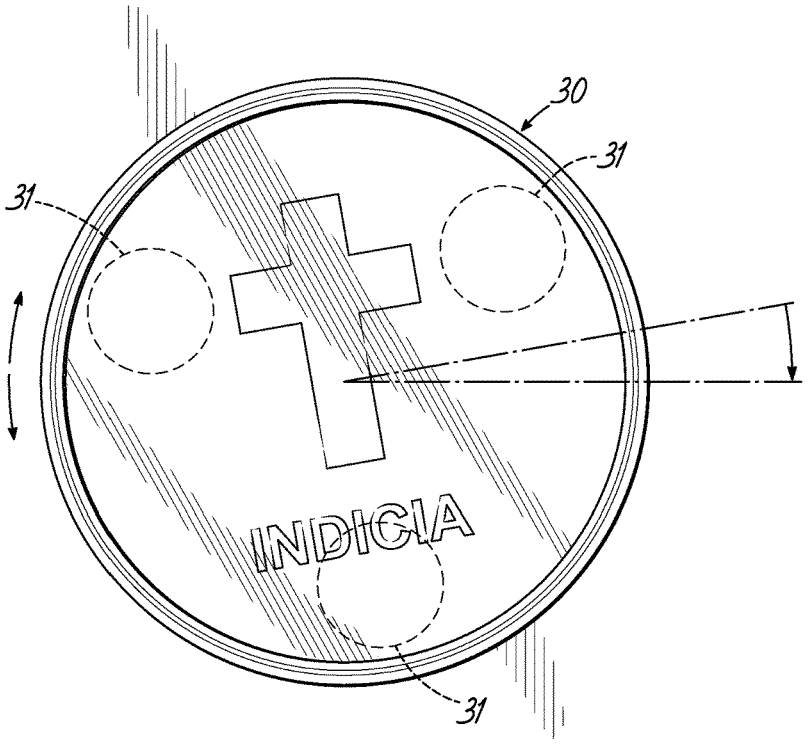
FIG. 6B is an assembled front view of the adapter plate and medallion of FIG. 6A with the medallion ornament out of plumb.
Figure 6C:
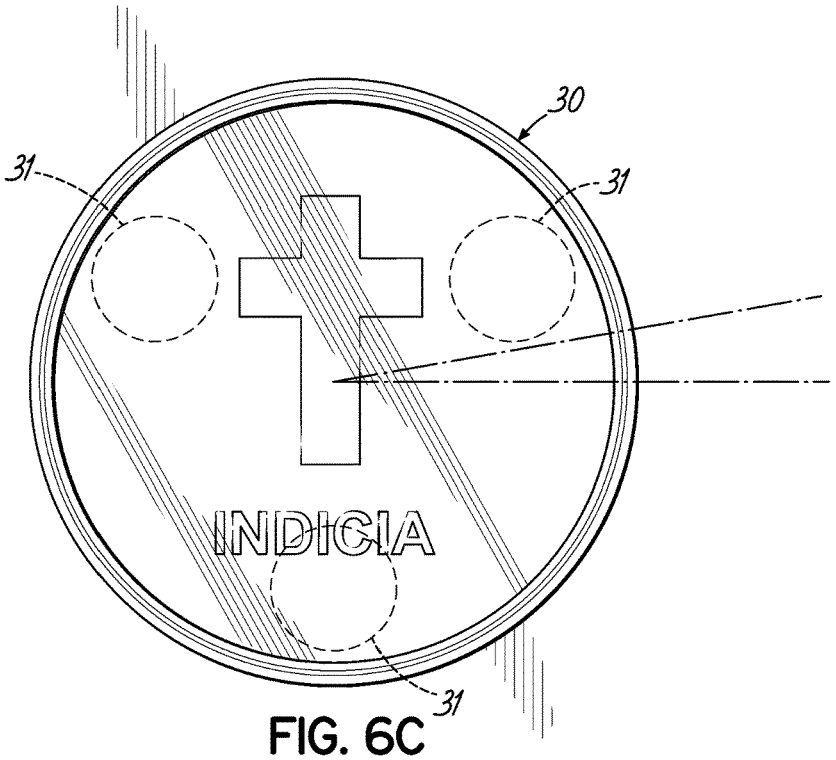
FIG. 6C is a view similar to FIG. 6B but with the medallion rotated relative to the adapter plate so that the medallion ornament is plumb.
Figure 7A:
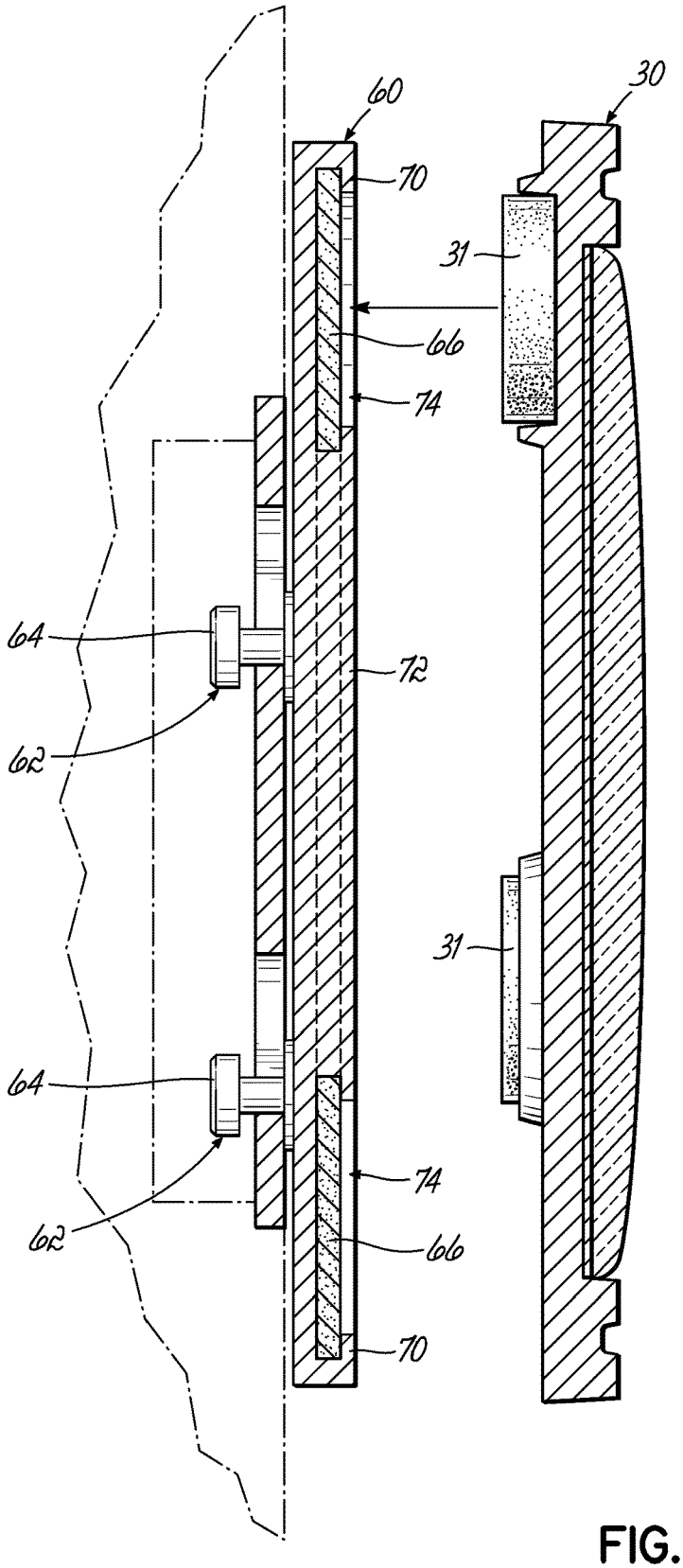
FIG. 7A is a disassembled side cross-sectional view of the adapter plate and medallion ornament of FIG. 5A.
Figure 7B:
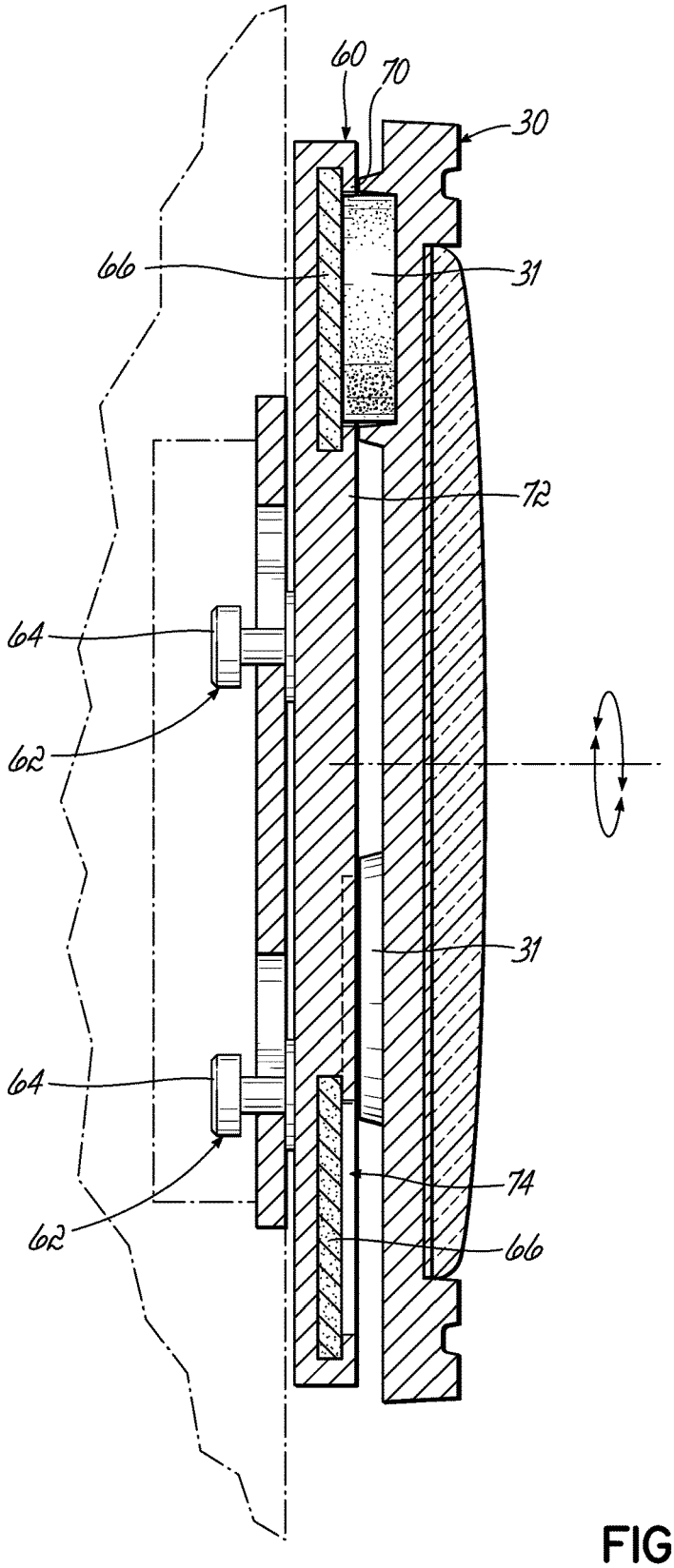
FIG. 7B is an assembled side cross-sectional view of the adapter plate and medallion ornament of FIG. 5A.

Referring now to FIG. 4, the dish assembly 22 is constructed in such a way as to permit medallions 30 to be placed anywhere on the cap panel 24. In this embodiment each of the medallions has one or more magnets 31 on a rear side thereof. The cap panel 24 is fabricated from a sheet of cardboard or chipboard 25 over which is placed a sheet of magnetic material 27, for example a ferrous material such as steel. The sheet of magnetic material 27 is then covered with a sheet of decorative material 29. Since the entire surface area of the cap panel 24 is magnetic material, medallions 30 can be placed anywhere within the surface area of the cap panel 24, i.e. they do not have to be placed within a designated recess. This permits more freedom in placing and arranging medallions as desired by the funeral director, and/or family, friends, and/or loved ones of the deceased.

Referring to FIGS. 5A-7B, a medallion casket ornament 30 includes at least one magnet 31, and preferably three magnets 31 equally spaced around a circumference of the ornament 30, mounted on a rear side of the ornament 30. A plastic injection molded adapter plate 60 has a pair of metallic vertically spaced fasteners 62 molded into a rear side of the adapter plate 60. Each fastener 62 includes a head 64 thereon. Adapter plate 60 also has an annular magnetic plate 66 molded into a front side of the plate 60. The annular magnetic plate 66 can be fabricated of a ferrous metal, for example a ferrous material such as steel, or other magnetic metal or material which is attracted by a magnet, or annular magnetic plate 66 can itself be a magnet. Accordingly, the term "magnetic plate" shall be construed to embrace all such meanings.

Figure 1:
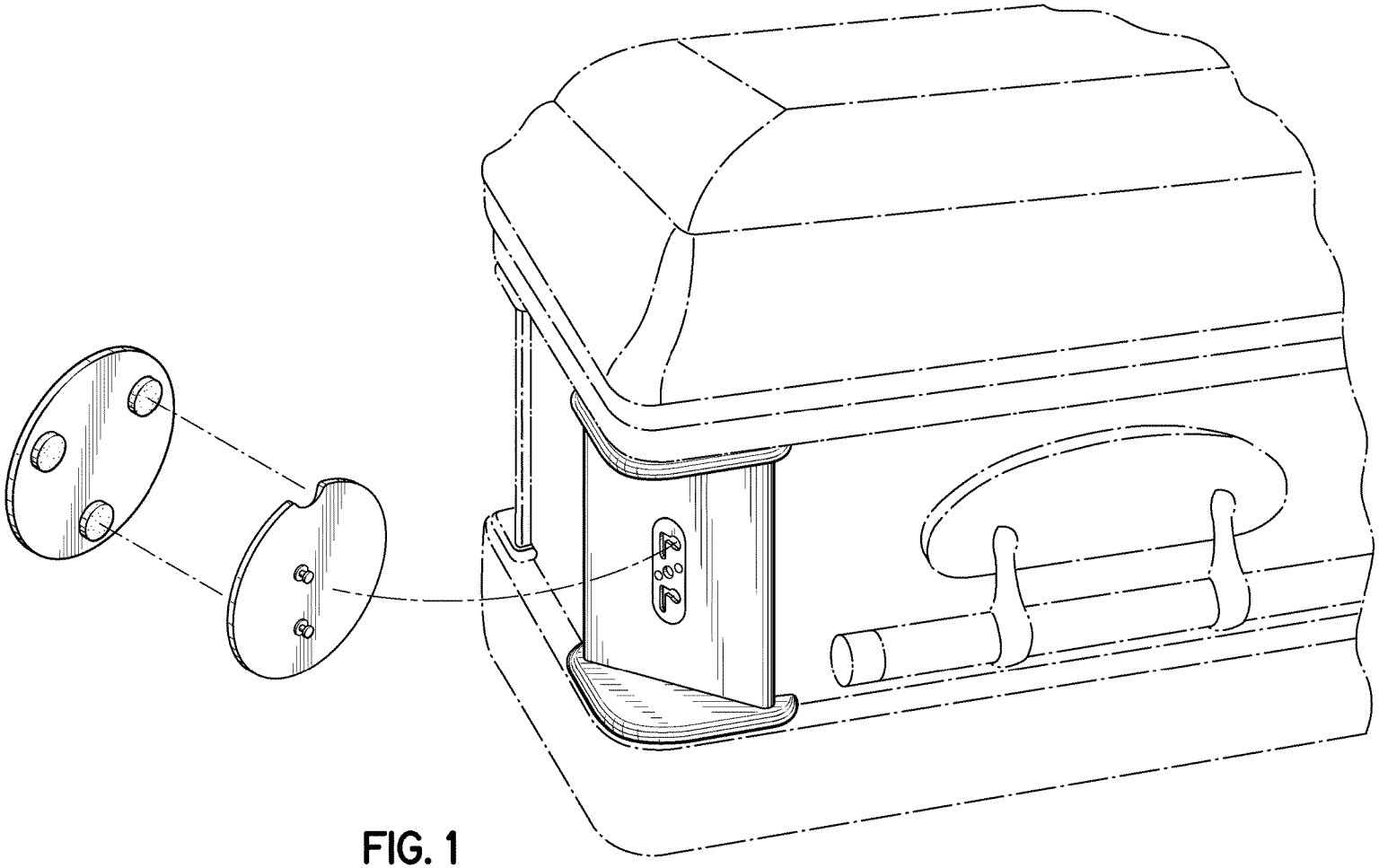
FIG. 1 PRIOR ART
FIG. 1 is a disassembled perspective view of one prior art adapter plate for attaching a medallion ornament to a casket corner.
Figure 2:
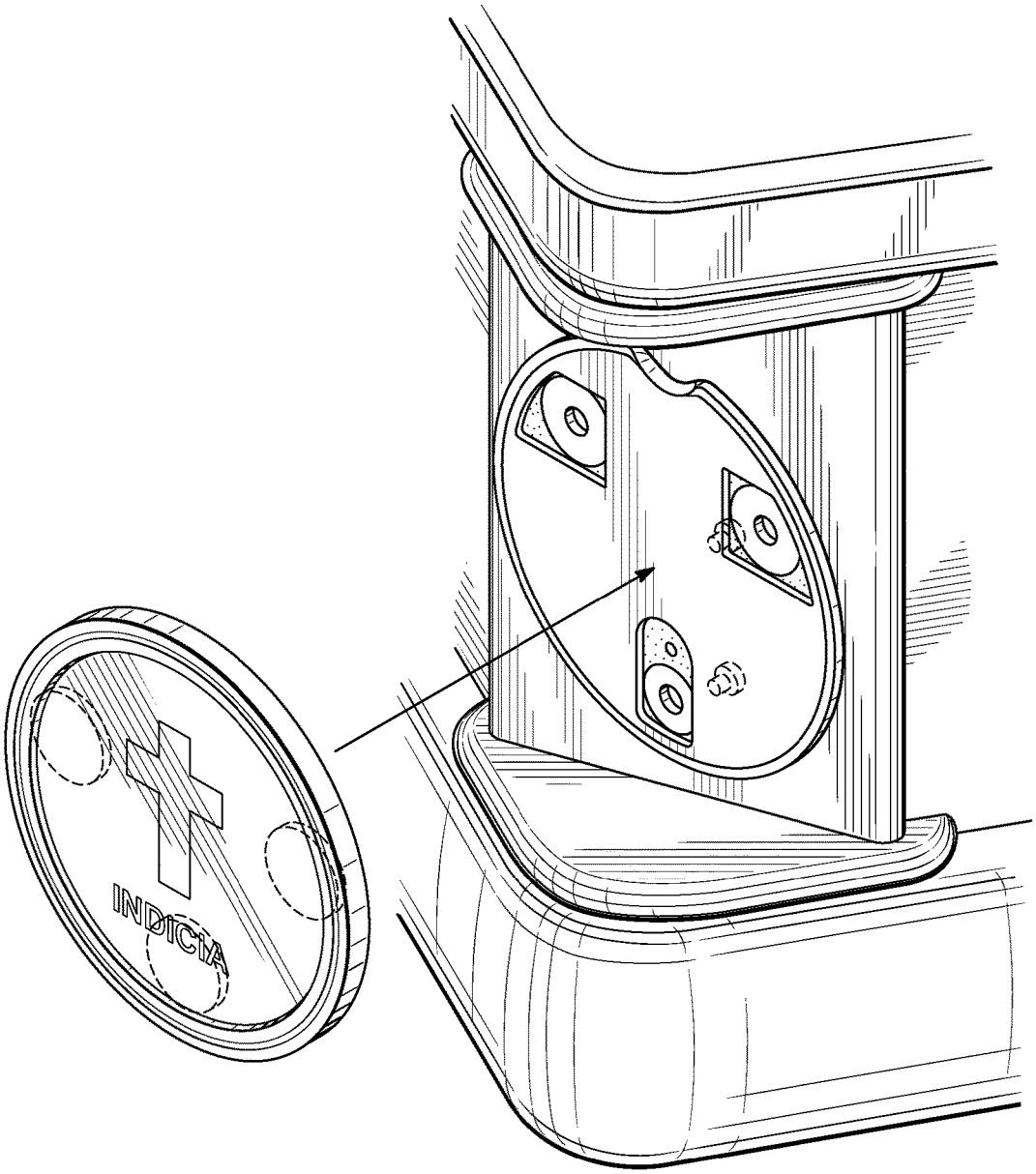
FIG. 2 PRIOR ART
FIG. 2 is a disassembled perspective view of another prior art adapter plate for attaching a medallion ornament to a casket corner.

The adapter plate 60 is removably secured to the casket shell by inserting the heads 64 of fasteners 62 in the casket shell keyhole grooves and seating the heads 64 of the fasteners 62 in the keyhole grooves as is known (FIG. 1). The ornament 30 is then removably secured to the casket shell by positioning the magnets 31 on the magnetic annular plate 66. Finally, to plumb the image on the ornament 30, the ornament 30 is rotated relative to the adapter plate 60 until the image on the ornament 30 is plumb.

The adapter plate 60 includes a forwardly projecting edge, rim, or flange 70 around a circumference of the plate 60. The adapter plate 60 also has a forwardly projecting circular feature 72 located centrally of the plate 60. The annular magnetic plate 66 is recessed relative to the flange 70 and the circular feature 72. The annular magnetic plate 66, flange 70, and circular feature 72 thus form an annular track 74 in which the magnets 31 are received. Thus, once ornament 30 is removably secured to adapter plate 60 by placing magnets 31 into contact with magnetic annular plate 66, the magnets 31 are positioned within the annular track 74. Rotating the ornament 30 relative to the adapter plate 60 causes the magnets 31 to slide on the annular magnetic plate 66 while being retained in the track 74. In this way the plumb of the ornament 30 may be adjusted while conveniently keeping the ornament 30 centered on the adapter plate 60.

One particularly desirable geometry for the ornament 30 is generally circular and generally disk-shaped, in which case the adapter plate 62 can also be generally circular and generally disk-shaped. The adapter plate 62 will generally be of a smaller diameter than the ornament 30 so as not to show.

It will of course be appreciated that the ornament attachment mechanism of this invention can be used in conjunction with cremation urns that are similarly equipped with keyhole grooves.

The adapter plate 60 also includes an edge scallop feature 76 at a periphery thereof that facilitates grasping the periphery of the adapter plate 60 to separate the adapter plate 60 from the ornament 30.

The invention herein can be utilized not only with casket shell corners and urns, but with other funerary articles that employ keyhole groove and fastener with head attachment of ornaments, as well. For example, the invention can be utilized with the casket cap dish assemblies of U.S. Pat. Nos. 7,657,981, 7,584,529, 7,159,287, and 6,715,190, all of which are hereby incorporated by reference herein as if fully set forth in their entirety. The invention can also be utilized with the display plaque of U.S. Pat. No. 6,557,222, and with the display pedestal of U.S. Pat. No. 6,691,385, both of which are hereby incorporated by reference herein as if fully set forth in their entirety.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. The invention resides in each individual feature described herein, alone, and in all combinations of any and all of those features. Departures may therefore be made from such details without departing from the spirit or scope of the general inventive concept. Accordingly, the scope of the invention shall be limited only by the following claims and their equivalents.

What is claimed is:

1. A casket comprising:

a casket shell, a casket lid closeable on said shell, at least one keyhole groove in said shell, a medallion casket ornament having a rear side, said ornament including at least one magnet mounted on said rear side, and an adapter plate having at least one rearward facing fastener with a head thereon and having a forward facing ring-shaped annular magnetic plate secured thereto, said adapter plate removably secured to said shell by inserting said head of said fastener in said keyhole groove and seating said head of said fastener in said keyhole groove, said ornament removably secured to said shell by positioning said at least one magnet of said ornament on said annular magnetic plate, said ornament plumbed by rotating said ornament relative to said adapter plate until said ornament is plumb.

2. The casket of claim 1 wherein said shell includes two vertically spaced said keyhole grooves therein, each being L-shaped, and wherein said adapter plate includes two vertically spaced said fasteners.

3. The casket of claim 1 wherein said ornament includes three said magnets mounted on said rear side, said three magnets being equally spaced around a circumference of said ornament.

4. The casket of claim 3 wherein said adapter plate is injection molded of plastic.

5. The casket of claim 4 wherein said fasteners are metallic, and wherein said fasteners and said annular magnetic plate are molded into said adapter plate.

6. The casket of claim 1 wherein said adapter plate and ornament are generally circular, and wherein a diameter of said adapter plate is less than a diameter of said ornament.

7. The casket of claim 6 wherein said adapter plate and said ornament are generally disk-shaped.

8. The casket of claim 1 wherein said adapter plate includes an edge scallop that facilitates grasping the periphery of said adapter plate to separate said adapter plate from said ornament.

9. A casket comprising:

a casket shell, a casket lid closeable on said shell, at least one keyhole groove in said shell, a medallion casket ornament having a rear side, said ornament including at least one magnet mounted on said rear side, and an adapter plate having at least one rearward facing fastener with a head thereon and having a forward facing annular magnetic plate, said adapter plate removably secured to said shell by inserting said head of said fastener in said keyhole groove and seating said head of said fastener in said keyhole groove, said ornament removably secured to said shell by positioning said at least one magnet of said ornament on said annular magnetic plate, said ornament plumbed by rotating said ornament relative to said adapter plate until said ornament is plumb, wherein said ornament includes three said magnets mounted on said rear side, said three magnets being equally spaced around a circumference of said ornament, wherein said adapter plate is injection molded of plastic, wherein said fasteners are metallic, and wherein said fasteners and said annular magnetic plate are molded into said adapter plate, wherein said adapter plate is circular, includes a forwardly projecting flange around a circumference thereof, and includes a forwardly projecting circular feature located centrally thereof, and wherein said annular magnetic plate is recessed relative to said flange and said circular feature thereby forming an annular track, whereby rotating said ornament relative to said adapter plate causes said three magnets to slide on said annular magnetic plate while being retained in said track.

10. A funerary receptacle for containing remains of a deceased, said receptacle comprising:

a container adapted to contain the remains, a lid closeable on said container, at least one keyhole groove in said container, a medallion funerary receptacle ornament having a rear side, said ornament including at least one magnet mounted on said rear side, and an adapter plate having at least one rearward facing fastener with a head thereon and having a forward facing ring-shaped annular magnetic plate secured thereto, said adapter plate removably secured to said container by inserting said head of said fastener in said keyhole groove and seating said head of said fastener in said keyhole groove, said ornament removably secured to said container by positioning said at least one magnet of said ornament on said magnetic annular plate, said ornament plumbed by rotating said ornament relative to said adapter plate until said ornament is plumb.

11. The funerary receptacle of claim 10 wherein said container is selected from a group consisting of a casket shell and a cremation urn.

12. The funerary receptacle of claim 10 wherein said container includes two vertically spaced said keyhole grooves therein, each being L-shaped, and wherein said adapter plate includes two vertically spaced said fasteners.

13. The funerary receptacle of claim 10 wherein said ornament includes three said magnets mounted on said rear side, said three magnets being equally spaced around a circumference of said ornament.

14. The funerary receptacle of claim 13 wherein said adapter plate is injection molded of plastic.

15. The funerary receptacle of claim 14 wherein said fasteners are metallic, and wherein said fasteners and said annular magnetic plate are molded into said adapter plate.

16. The funerary receptacle of claim 10 wherein said adapter plate and ornament are generally circular, and wherein a diameter of said adapter plate is less than a diameter of said ornament.

17. The funerary receptacle of claim 16 wherein said adapter plate and said ornament are generally disk-shaped.

18. The funerary receptacle of claim 10 wherein said adapter plate includes an edge scallop that facilitates grasping the periphery of said adapter plate to separate said adapter plate from said ornament.

19. A funerary receptacle for containing remains of a deceased, said receptacle comprising:

a container adapted to contain the remains, a lid closeable on said container, at least one keyhole groove in said container, a medallion funerary receptacle ornament having a rear side, said ornament including at least one magnet mounted on said rear side, and an adapter plate having at least one rearward facing fastener with a head thereon and having a forward facing annular magnetic plate, said adapter plate removably secured to said container by inserting said head of said fastener in said keyhole groove and seating said head of said fastener in said keyhole groove, said ornament removably secured to said container by positioning said at least one magnet of said ornament on said magnetic annular plate, said ornament plumbed by rotating said ornament relative to said adapter plate until said ornament is plumb, wherein said ornament includes three said magnets mounted on said rear side, said three magnets being equally spaced around a circumference of said ornament, wherein said adapter plate is injection molded of plastic, wherein said fasteners are metallic, and wherein said fasteners and said annular magnetic plate are molded into said adapter plate, wherein said adapter plate is circular, includes a forwardly projecting flange around a circumference thereof, and includes a forwardly projecting circular feature located centrally thereof, and wherein said annular magnetic plate is recessed relative to said flange and said circular feature thereby forming an annular track, whereby rotating said ornament relative to said adapter plate causes said three magnets to slide on said annular magnetic plate while being retained in said track.

20. A funerary article comprising:

a mounting surface including at least one keyhole groove therein, a medallion funerary article ornament having a rear side, said ornament including three circumferentially equally spaced magnets mounted on said rear side, and a plastic adapter plate having at least one rearward facing metallic fastener with a head thereon and having a forward facing ring-shaped annular magnetic plate secured thereto, said adapter plate removably secured to said mounting surface by inserting said head of said fastener in said keyhole groove in said mounting surface and seating said head of said fastener in said keyhole groove, said ornament removably secured to said adapter plate by positioning said magnets of said ornament on said annular magnetic plate, said ornament plumbed by rotating said ornament relative to said adapter plate until said ornament is plumb.

* * * * *